US005649505A

United States Patent [19]

Tussing

[11] Patent Number: 5,649,505

[45] Date of Patent: Jul. 22, 1997

[54] MULTIPLE-HOLE, PISTON COOLING NOZZLE AND ASSEMBLY ARRANGEMENT THEREFORE

[75] Inventor: Brian L. Tussing, Columbus, Ind.

[73] Assignee: Cummins Engine Company, Inc., Columbus, Ind.

[21] Appl. No.: 588,133

[22] Filed: Jan. 18, 1996

[51] Int. Cl.[6] ..... F01P 1/04

[52] U.S. Cl. ..... 123/41.35; 123/41.39

[58] Field of Search ..... 123/41.35, 41.39, 123/41.31, 41.34

[56] References Cited

U.S. PATENT DOCUMENTS

| | | | |
|---|---|---|---|
| 3,359,864 | 12/1967 | Hamlin | 91/503 |
| 4,206,726 | 6/1980 | Johnson, Jr. et al. | 123/41.35 |
| 4,408,575 | 10/1983 | Clairmont, Jr. et al. | 123/41.35 |
| 4,508,065 | 4/1985 | Suchdev | 123/41.35 |
| 4,979,473 | 12/1990 | Lee | 123/41.35 |
| 4,995,346 | 2/1991 | Hudson, Jr. | 123/41.35 |
| 5,267,534 | 12/1993 | Berlinger | 123/41.35 |
| 5,503,116 | 4/1996 | Wolf | 123/41.35 |
| 5,533,472 | 7/1996 | Sands et al. | 123/41.33 |

*Primary Examiner*—David A. Okonsky
*Attorney, Agent, or Firm*—Woodward, Emhardt, Naughton, Moriarty & McNett

[57] ABSTRACT

A piston cooling nozzle for an internal combustion engine includes a two-part construction comprising a mounting base and a main body. The mounting base includes a substantially flat end panel which is designed to attach directly to a plateau area on the engine block. The mounting base also includes a plug portion which is designed to seal closed an open end of the main body. The main body includes a through hole which is located in communication with an engine oil rifle. The main body represents a single piece component with an extension arm and cooling nozzle head. The extension arm includes a plurality of drilled passageways which are in communication with four flow jet apertures in the cooling nozzle head. The cooling nozzle head has a generally triangular shape and the four flow jet apertures are arranged so as to track the arc-like curvature of the corresponding piston cooling gallery. Oil flowing through the oil rifle passes through the extension arm and exits from the cooling nozzle head as four narrow and well defined jets of oil. These four jets of oil are targeted at an entrance area for the piston cooling gallery. The configuration of the piston cooling nozzle is such that it may be installed directly into an assembled engine without interference. By dividing a single flow stream into four individual jets, there is a increase in the length to diameter ratio resulting in less stream divergence and a more targeted spray.

12 Claims, 10 Drawing Sheets

MULTIPLE-HOLE, PISTON COOLING NOZZLE AND ASSEMBLY ARRANGEMENT THEREFORE

BACKGROUND OF THE INVENTION

The present invention relates in general to piston cooling nozzles and the manner of assembly and use of a piston cooling nozzle relative to an engine piston. More specifically the present invention relates to a piston cooling nozzle with a plurality of separated flow passageways which are designed to improve the targeting of the exiting spray plume against or into a desired area of the piston.

It is generally recognized that some small percentage of the heat available in the fuel will be absorbed by the pistons. While this percentage is only in the 3 to 8 percent range for aluminum alloy pistons, there is still a noticeable rise in the temperature of the piston due to this heat absorption. While there will be some heat transfer away from the piston and hence some cooling, additional cooling is frequently needed to keep the piston temperature within a safe range. The heat already being transferred comes from the rings, the land and skirt portions of the piston, and is transferred to the water jacket and to the crankcase oil by means of conduction. A splash or spray mist of crankcase oil is the conduit for this portion of the heat transfer. If higher than desired piston temperatures occur and there is insufficient cooling, the result will be increased crown, top land and top groove carbon deposits. As a general rule, top groove temperatures greater than 220 degrees C. (428 degrees F.) are considered excessive.

Under certain conditions some form of oil cooling of the piston becomes virtually essential to ensure satisfactory operation. One technique which is used to enable additional cooling by way of oil cooling is to provide a special oil feed/jet arrangement in combination with a specific piston design. While there are a variety of arrangements, the gallery-type of supplemental oil cooling may be the most popular. With this approach, a single-passageway nozzle is directed up into the piston and a divergent, non-targeted plume of oil is sprayed onto the underside of the piston. The divergent, non-targeted spray results in some portion of the oil being sprayed against piston surfaces which are not critical and which are not the preferred surfaces for the most effective cooling and heat transfer. When the piston is a galleried type, the preferred location for the plume of oil is directly into the gallery. However, with a divergent, non-targeted spray pattern, only a small portion of the cooling oil will actually be sprayed into the gallery. It is possible by the use of a properly designed test fixture to evaluate the collection efficiency for a particular piston cooling nozzle design. Such a test fixture provides the ability to compare competing nozzle designs relative to their collection efficiency.

The present invention improves upon the current designs for piston cooling nozzles by providing a new nozzle design that creates a targeted oil jet plume. With a targeted spray, it is easier to position and direct the spray to a localized and specific area of the piston such as a piston gallery opening. A related design challenge with regard to the present invention involved trying to adapt the new piston cooling nozzle into the existing engine design as an upgraded and improved replacement for the existing, less efficient piston cooling nozzles. In such a situation, the design of the engine block, cylinder liner, and crank counterweights are all fixed. Therefore, there are specific structural and dimensional constraints which have to be factored into the piston cooling nozzle design. Whether or not a piston cooling nozzle is already present in the engine design, it is important when providing an improved nozzle design that it be able to assemble into the engine without requiring any other modifications, redesign, or major disassembly. The ease of assembly and servicing are important factors to consider as well as the configuration and tolerancing of the nozzle relative to production costs.

The present invention has addressed the non-targeted spray pattern problem as well as the ease of assembly and cost concerns. The resulting invention structure achieves various objectives in a novel and unobvious manner. By means of a suitable test fixture it has been found that the invention achieves a collection efficiency of over 87 percent. This number refers to the volume of cooling oil which is collected into the piston cooling gallery relative to the total oil which is sprayed at the piston.

Since a variety of flow nozzle designs have been patented, including piston cooling nozzles, it may be helpful for an understanding of the present invention and its uniqueness and novelty to review some of these earlier design attempts. Listed below are three United States patents which are believed to be a representative sampling of these earlier nozzle designs:

| PATENT NO. | PATENTEE | ISSUE DATE |
|---|---|---|
| 3,359,864 | Hamlin | Dec. 26, 1967 |
| 4,408,575 | Clairmont, Jr. | Oct. 11, 1983 |
| 4,508,065 | Suchdev | Apr. 2, 1985 |

In addition to earlier patents, some piston cooling nozzle designs are disclosed in the technical literature. In the reference book entitled "Diesel Engine Reference Book" (Butterworth & Company Ltd., 1984), the editing author LRC Lilly describes various piston designs and types on pages 12-4 through 12-9. In Figure 12.4, a traditional oil feed/jet arrangement is shown.

An important part of the present invention involves the specific nozzle design which has been invented. As such it is helpful to understand that by separating a single turbulent flow stream of cooling oil into a plurality of smaller more laminar flow streams, the same volume of oil can be provided, but the spray divergence will be reduced, enabling more targeted jets of oil. The various jets of oil are still all targeted at virtually the same point, but an increase in the length to diameter ratio results in a jet with less radial divergence (i.e., decreased cone angle). With regard to specific nozzle designs, the three previously listed patent references may be of interest. Even though there may be several examples of piston cooling nozzles and assembly arrangements, the present invention remains novel and unobvious.

SUMMARY OF THE INVENTION

A piston cooling nozzle for an internal combustion engine according to one embodiment of the present invention comprises a mounting base which is constructed and arranged for attachment to an engine block. Additionally the piston cooling nozzle of the present invention includes a main body portion which defines a hollow interior space and which is open at one end for receiving therein an inserting portion of the mounting base. An extension arm portion is integrally formed as part of the main body portion and defines therethrough at least one flow passageway which is in flow communication with the interior space. At the end of the extension arm portion opposite from the mounting base is a cooling nozzle head which defines a plurality of separated flow jet apertures, each of which is constructed and arranged so as to be in flow communication with the interior space by way of the extension arm portion. This plurality of flow jet apertures is directed at a cooling gallery formed within the piston which is to be cooled by the corresponding piston cooling nozzle. Cooling oil is delivered by an oil rifle extending through a portion of the engine block and positioned in flow communication with the interior space. Oil flowing through the oil rifle flows under pressure into the interior space, through the extension arm portion and exits from the plurality of flow jet apertures as a plurality of targeted streams. The flow jet apertures are arranged in a pattern which approximates the shape of the piston gallery opening so as to enhance the collection efficiency.

One object of the present invention is to provide an improved piston cooling nozzle.

Related objects and advantages of the present invention will be apparent from the following description.

DESCRIPTION OF THE PREFERRED EMBODIMENT

Figure 4:
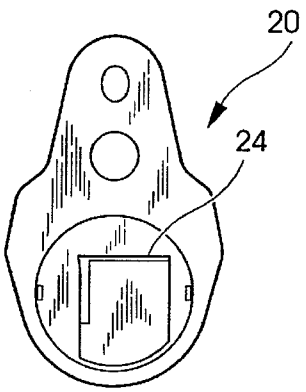
FIG. 4 is a front elevational view of the FIG. 1 piston cooling nozzle.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3A:
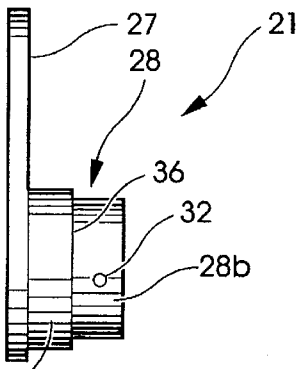
FIG. 3A is a side elevational view of a base member which is part of the FIG. 1 piston cooling nozzle.

Referring to FIGS. 1–5 there is illustrated a piston cooling nozzle 20 which is designed according to the present invention. Nozzle 20 includes a base 21, main body 22, arm 23, and nozzle extension 24. The base 21 includes a substantially flat end plate 27 (see FIG. 3) and an integral (one-piece) generally cylindrical plug portion 28 (see FIG. 3A). Plug portion 28 is stepped down from larger diameter section 28*a* to a smaller insertion diameter at section 28*b*. Cylindrical section 28*b* is pressed into the generally cylindrical open end 29 of main body 22 in order to seal closed this open end. A roll pin 30 is inserted into drilled hole 31 of main body 22 and locks into drilled hole 32 of section 28*b*. This roll pin 30 functions to anchor the fit between base 21 and main body 22. The annular groove 34 defined by the edge 35 of open end 29 of main body 22 and the edge 36 between sections 28*a* and 28*b* is fitted with a sealing O-ring 37.

End plate 27 defines a small oblong opening 27*a* and a larger circular opening 27*b*. As will be explained hereinafter, the side of the engine block where piston cooling nozzle 20 is assembled is a flat plateau area against which end plate 27 mounts. The small oblong opening 27*a* cooperates with a pin location for initial positioning and clearance opening 27*b* receives a threaded fastener which threads into a tapped hole in the mounting plateau area of the engine block. Blind hole 38 is used primarily for pull-out removal of the piston cooling nozzle 20.

Main body 22, arm 23, and nozzle extension 24 are of unitary construction and fabricated from and are part of the same initial block of material. In use, assuming a typical engine design, arm 23 extends in a first direction which is substantially perpendicular to the cylinder axis. The nozzle extension 24 extends axially in a second direction which is substantially perpendicular to the first direction. Further, the nozzle extension extends toward the cylinder. The main body 22 is generally cylindrical and hollow with a crossing through-hole 40 which is positioned in line with the piston cooling oil rifle of the engine block so as to automatically accept cooling oil. End 41 is closed except for three drilled holes 42–44 which extend through end 41 and essentially run the full length of arm 23. These cooling oil flow holes 42–44 are in flow communication with the four nozzle flow passages represented by holes 45–48 which extend down through nozzle extension 24 (see FIG. 2). Additionally, the four nozzle jet holes 45–48 are in flow communication with the hollow interior of main body 22 by way of connecting flow holes 42–44 in arm 23. In the preferred embodiment, hole 42 communicates with hole 45, hole 43 communicates with hole 46, and hole 44 communicates with holes 47 and 48.

Annular groove 51 which is machined into the outer surface 52 of main body 22 is fitted with a rigid seal ring 53.

The specific size, shape, and geometry of piston cooling nozzle 20 are selected for the preferred embodiment so that the nozzle is able to be installed in a Cummins Engine Company (Columbus, Ind.) diesel engine. However, the teachings of the present invention and the cooling theory and nozzle design are applicable to other engine designs and cooling requirements.

Figure 2:
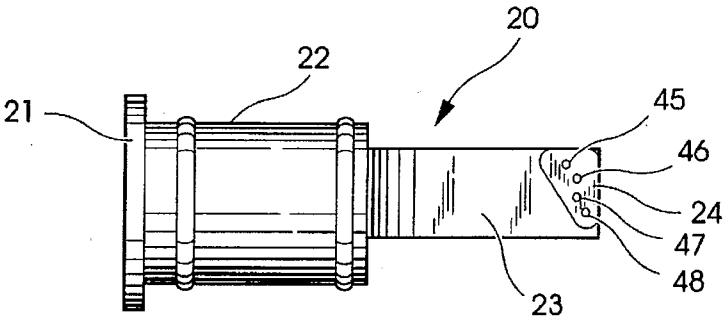
FIG. 2 is a top plan view of the FIG. 1 piston cooling nozzle.

One aspect of the cooling theory of the present invention involves the use of a plurality of flow passages represented by nozzle holes 45–48 in the nozzle extension 24. This plurality (four) of passages terminating in nozzle holes 45–48 is a replacement for a single flow passage, as is typical of other piston cooling nozzles. By dividing this more turbulent single flow stream into a plurality of substantially more laminar flow streams, it is possible to create a more stable flow jet at the nozzle exits (holes 45–48) which can be more accurately targeted. The use of four individual laminar flow jets results in a reduction in the jet cone angle. One key feature is the length to diameter ratio. Assuming a length of 0.70 inches and a diameter of 0.07 inches for the present invention, there is a length to diameter ratio of 10 to 1. If the outlet flow area is provided by a single flow hole which provides the same total flow area, the length to diameter ratio will be 5 to 1. With a single larger hole the ratio is not as favorable as when the hole diameter is reduced while keeping the length the same. The larger ratio with the present invention results in spray plume reduction and a more focused and targeted flow stream from each of the four nozzle holes 45–48. The resultant tighter spray enables each jet to be specifically aligned with and directed at its corresponding piston cooling gallery. While a longer nozzle extension up into the piston would allow a targeted spray with a minimal spray divergence, the assembly of such a modified piston cooling nozzle and the requirement to be placed up into the piston inside the cylinder liner becomes more costly and extremely difficult to accomplish. This type of design typically involves major disassembly in order to install and/or remove such a piston cooling nozzle. With the preferred embodiment of the present invention, there is a shorter nozzle extension 24 which has a generally triangular shape as illustrated in FIG. 2. This shorter nozzle extension version of the present invention enables the nozzle 20 to be easily installed since the nozzle extension is low enough to clear the piston skirt and provides the requisite cylinder liner clearance. The design of piston cooling nozzle 20 is also such that is avoids any interference with crankshaft counterweights.

Another feature of the present invention involves the specific pattern of nozzle holes 45–48 and their position relative to the piston cooling gallery and the opening into that gallery which is defined by the two primary components which comprise the corresponding piston as will be described hereinafter in connection with FIGS. 8 through 14. In the present invention the four nozzle holes 45–48 are actually aligned in something of an arc-like shape that follows the general circumferential curvature of the piston cooling gallery. In particular the four holes are aligned so as to track the shape of the opening into the piston cooling gallery. The piston cooling gallery is centered between the ring-pack ID and the pin boss OD. The triangular shape of the nozzle extension is selected based upon the number, size, and spacing of the nozzle holes. Here again, the specific shape and style of the cooling gallery and the engine design will influence the size, shape, and style of the nozzle extension and the layout of the nozzle holes. This specific shape and style of piston cooling nozzle has a significant, quantifiable influence on attaining a high oil-collection efficiency.

Figure 1:
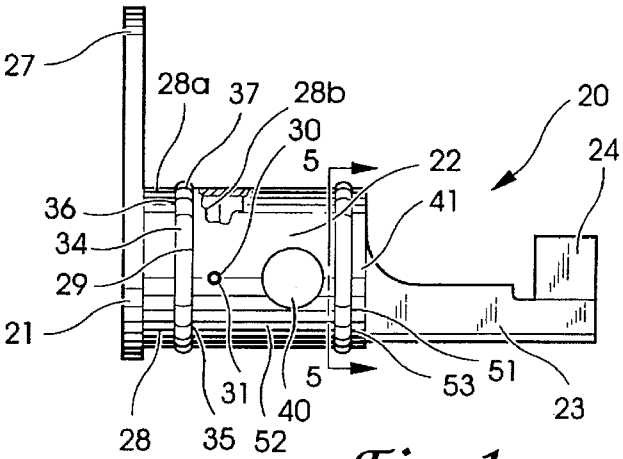
FIG. 1 is a side elevational view of a piston cooling nozzle according to a typical embodiment of the present invention.
Figure 3:
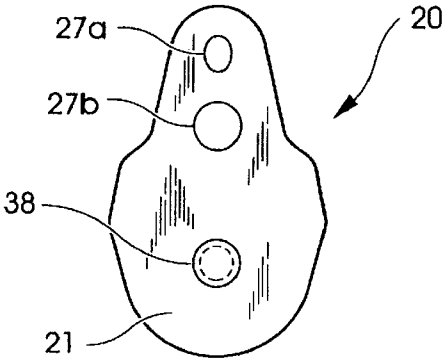
FIG. 3 is a rear elevational view of the FIG. 1 piston cooling nozzle.
Figure 5:
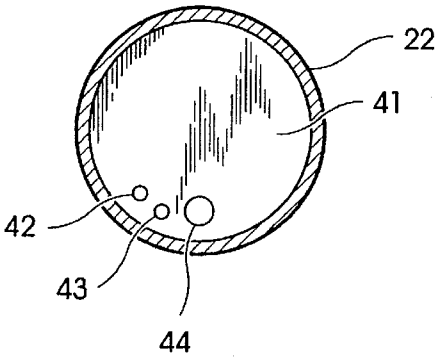
FIG. 5 is a rear elevational view in full section of the FIG. 1 piston cooling nozzle as viewed in the direction of line 5—5 in FIG. 1.
Figure 6:
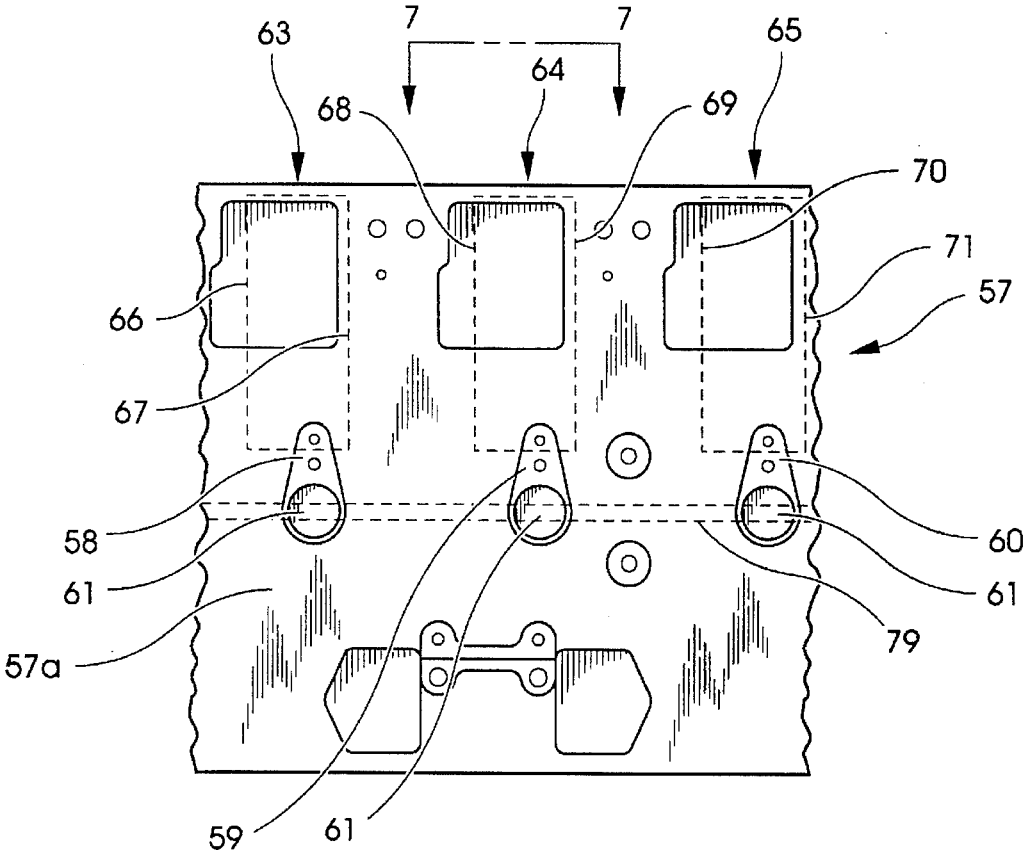
FIG. 6 is a partial side elevational view of an internal combustion engine block showing the mounting location for the FIG. 1 piston cooling nozzle.

Referring to FIG. 6, a portion of an engine block 57 is illustrated in order to describe where and how the FIG. 1 piston cooling nozzle 20 is installed. The FIG. 6 engine block representation is typical of a Cummins Engine Company engine design and piston cooling nozzle 20 is specifically styled for a Cummins Engine Company engine.

Positioned along the outer wall 57*a* of block 57 is a series of recessed, tear drop-shaped plateaus 58–60. The exact number of such plateaus will depend on the engine and specifically the number of cylinders. Each plateau is aligned with a corresponding cylinder into which a liner and piston are installed. The shape of the end plate 27 of base 21 generally corresponds to the shape of plateaus 58–60 such that each end plate 27 abuts up against its corresponding plateau while the main body, arm, and nozzle extension extend through main opening 61 into the area directly below the corresponding piston.

As would be understood, the FIG. 6 partial illustration is oriented such that the cylinder bore extends up and down or axially in the plane of the paper. The cylinder bores 63–65 associated with plateaus 58–60 are each illustrated by a pair of parallel broken lines, 66–67, 68–69, and 70–71. When a piston cooling nozzle is mounted into position with the base 21 attached to a corresponding plateau by the threaded hardware as previously described, the arm extends inwardly into the block in a direction with is substantially normal to the cylindrical axis of the corresponding cylinder bore. When the engine assembly is completed, the cylinder liner and piston will be positioned above nozzle extension 24 when the engine has the FIG. 6 orientation. Below the nozzle extension of each piston cooling nozzle 20 which is installed within engine block 57 is the engine crankshaft (see FIG. 7) and counterweights. In order for the piston cooling nozzle 20 to be easily installed without interference after the engine is otherwise assembled, it is necessary to size and shape the piston cooling nozzle relative to these other engine parts.

Figure 7:
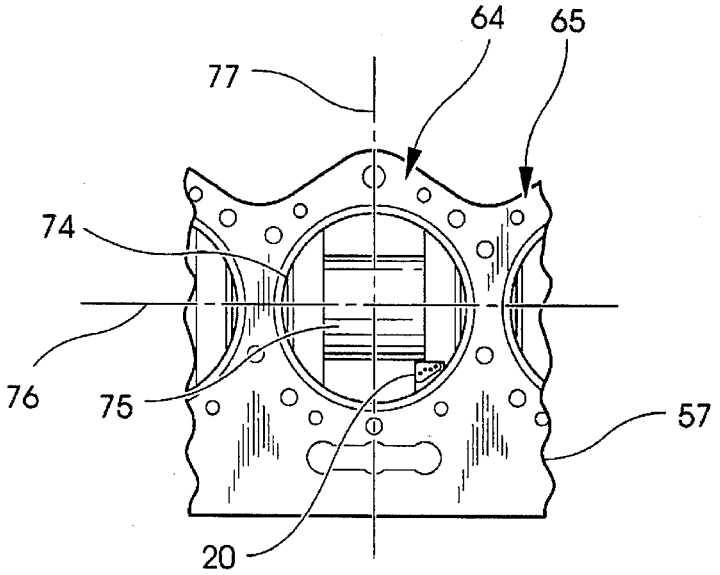
FIG. 7 is a top plan view of the FIG. 6 engine block as viewed in the direction of line 7—7 in FIG. 6 and with the FIG. 1 piston cooling nozzle installed.

With reference to FIG. 7, the interior of the engine block as viewed down through cylinder bore 64, is illustrated. In the FIG. 7 illustration, only the cylinder liner 74 has been installed, the piston and connecting rod are not illustrated. The orientation for FIG. 7 is set forth in FIG. 6 and a portion of the crankshaft 75 can be seen. One piston cooling nozzle 20 according to the present invention has been mounted in position and its extension into the hollow interior of the cylinder liner is illustrated. As shown, the nozzle extension is located in the lower right quadrant based on the FIG. 7 illustration below the horizontal centerline 76 and to the right of the vertical centerline 77. The nozzle extension 24 is located above crankshaft 75 and does not interfere with the movement of any of the engine parts.

While the engine specifics for the illustrated Cummins Engine Company engine design have dictated several of the sizes and shapes of piston cooling nozzle 20, the structure of nozzle 20 can be used as a guide for the design of piston cooling nozzles for other engines. The desire is to be able to insert the piston cooling nozzle directly into the block, below the cylinder liner, and above the crankshaft without interference. This is one of the more important features of the overall design and the other important feature is to divide the conventional single flow stream into four separate flow jets to allow for better direction and targeting of the spray. The increase in the length/diameter ratio creates a more narrow spray with less divergence. This is important in any design where the nozzle extension is positioned several inches away from (below) the target area. The greater the separation distance, the more important it is to narrow each flow jet or flow stream so that a greater percentage of the cooling oil actually reaches the target area (i.e., higher collection efficiency).

Referring again to FIG. 6, the location of oil rifle 79 is illustrated. Oil rifle 79 is a machined flow passageway within the engine block which is located in line with and behind plateaus 58–60. Considering the depth of the engine block into the plane of the paper, the oil rifle 79 is located between the surfaces of plateaus 58–60 and the closest edge of the cylinder bores. The exact location of oil rifle 79 can be appreciated by understanding that the through hole 40 of each assembled piston cooling nozzle is positioned directly in the flow path created by the oil rifle 79. As a result of this relationship, oil flowing under pressure through the oil rifle 79 will flow into each piston cooling nozzle through hole 40. With the open end 29 blocked off by base 21, the path of least resistance for the oil is initially through drilled holes 42–44 and then to nozzle holes 45–48. The flow of oil through oil rifle 79 provides four continuous jet streams of cooling oil focused on the target area of the piston cooling gallery.

The specific pattern of nozzle holes 45–48 is selected based upon the location and geometry of the target area. Since the tip of each nozzle hole is several inches away from the target area (opening to the piston cooling gallery), it is important to cut down on the divergence of the spray from each nozzle as has been described relative to the selected length to diameter ratio. It is also important to position each nozzle hole so that the entire pattern approximates the curved or arc geometry of the piston gallery and specifically the arc shape of the opening into the cooling gallery. In the present invention, the cooling gallery has an arc-like curvature and thus the pattern of nozzle holes 45–48 has a form which tries to track or simulate this curvature.

As to the style of piston which is assembled into the illustrated engine block, it is a two-part design, having a crown portion and a skirt portion. Although referred to as an "articulated" piston, it could also be described as a "composite" piston. Ideally a piston needs to be strong enough to withstand the forces associated with the expanding combustion gases while being kept light in weight to reduce bearing loads as much as possible. One answer is to fabricate the crown portion out of malleable iron or steel and the skirt portion out of aluminum.

Figure 8:
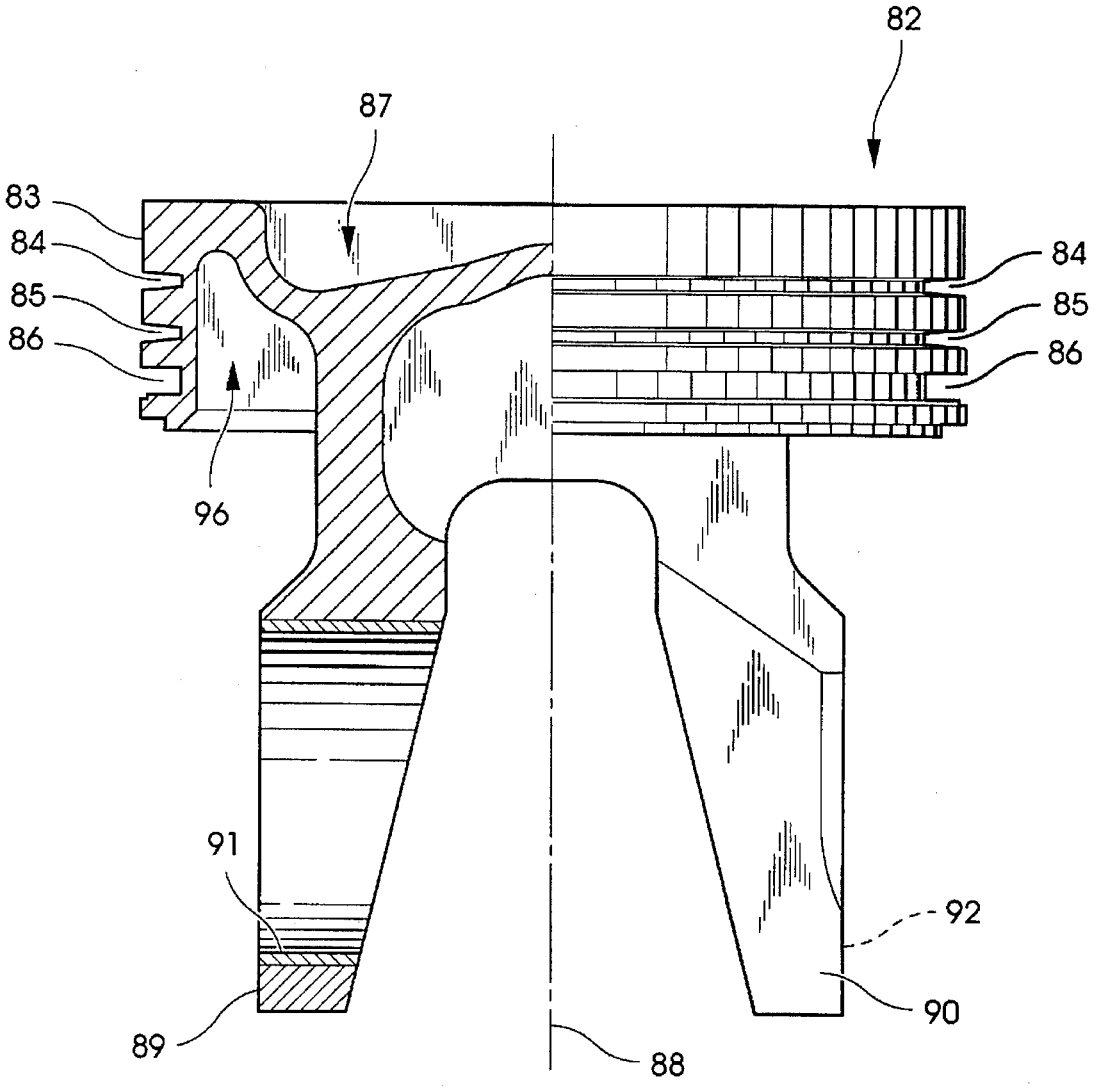
FIG. 8 is a front elevational view in half section of a piston crown portion of the piston design to be cooled by the delivery of cooling oil from the FIG. 1 piston cooling nozzle.
Figure 9:
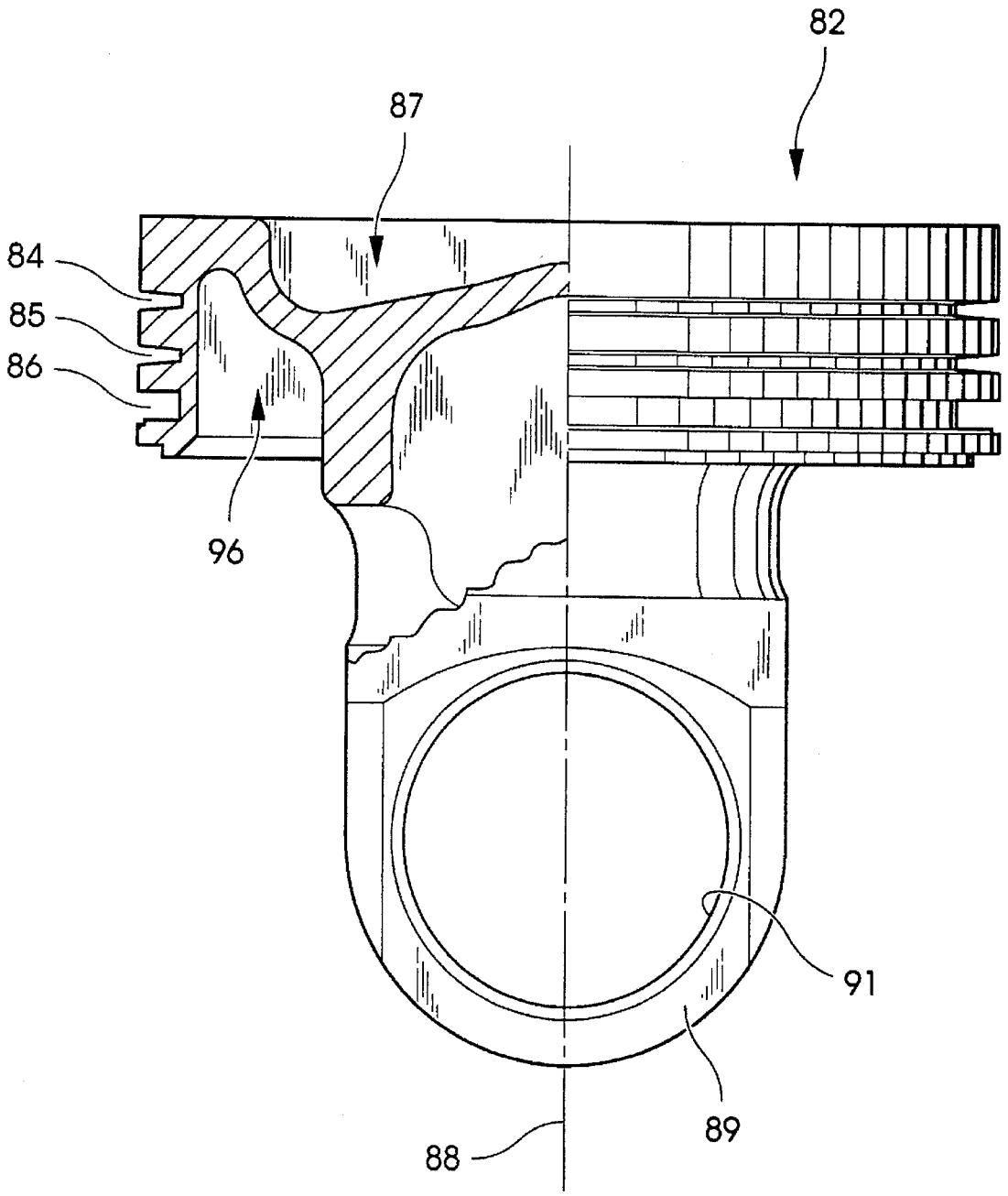
FIG. 9 is a side elevational view in half section of the FIG. 8 piston crown portion.
Figure 10:
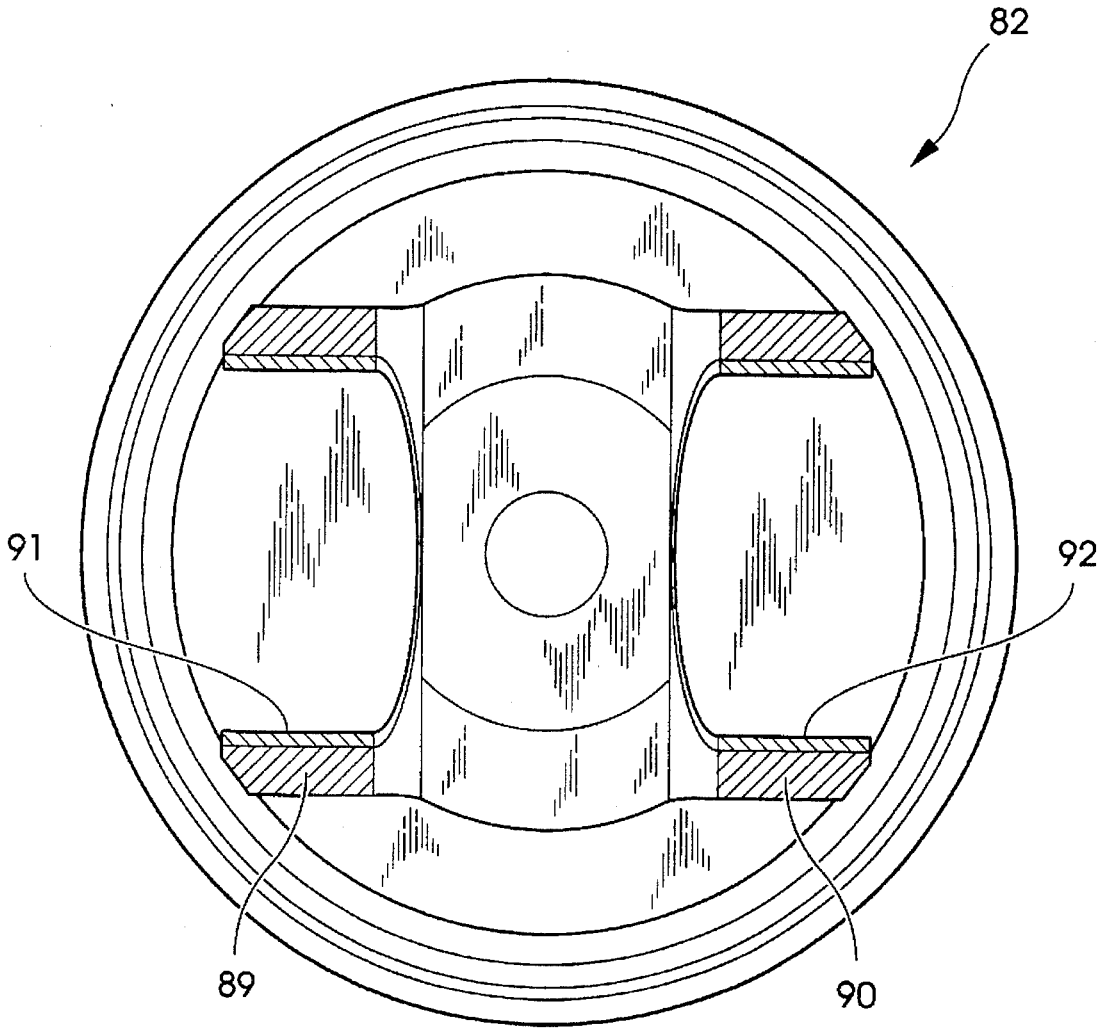
FIG. 10 is a bottom plan view of the FIG. 8 piston crown portion.
Figure 11:
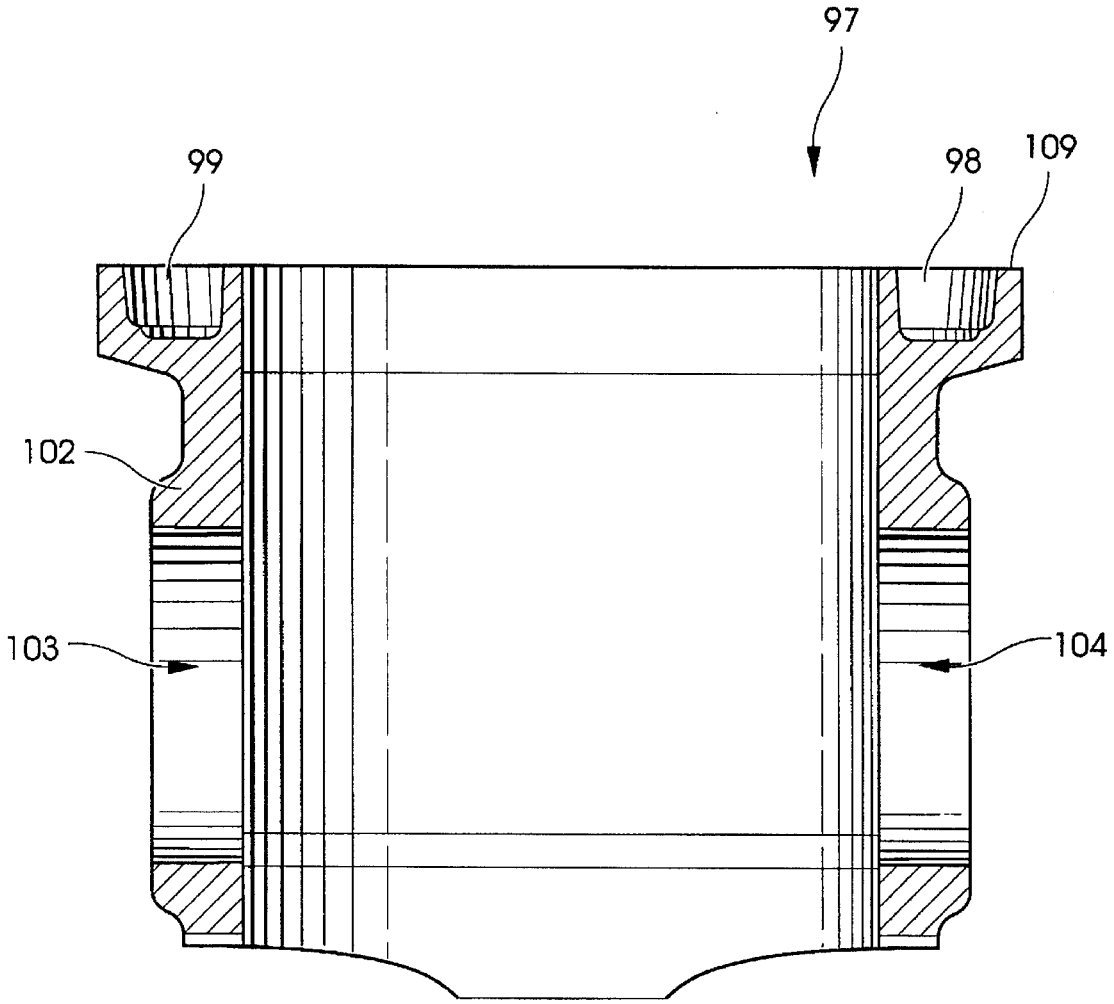
FIG. 11 is a front elevational view in full section of a skirt portion of the piston design which receives cooling oil from the FIG. 1 piston cooling nozzle.
Figure 12:
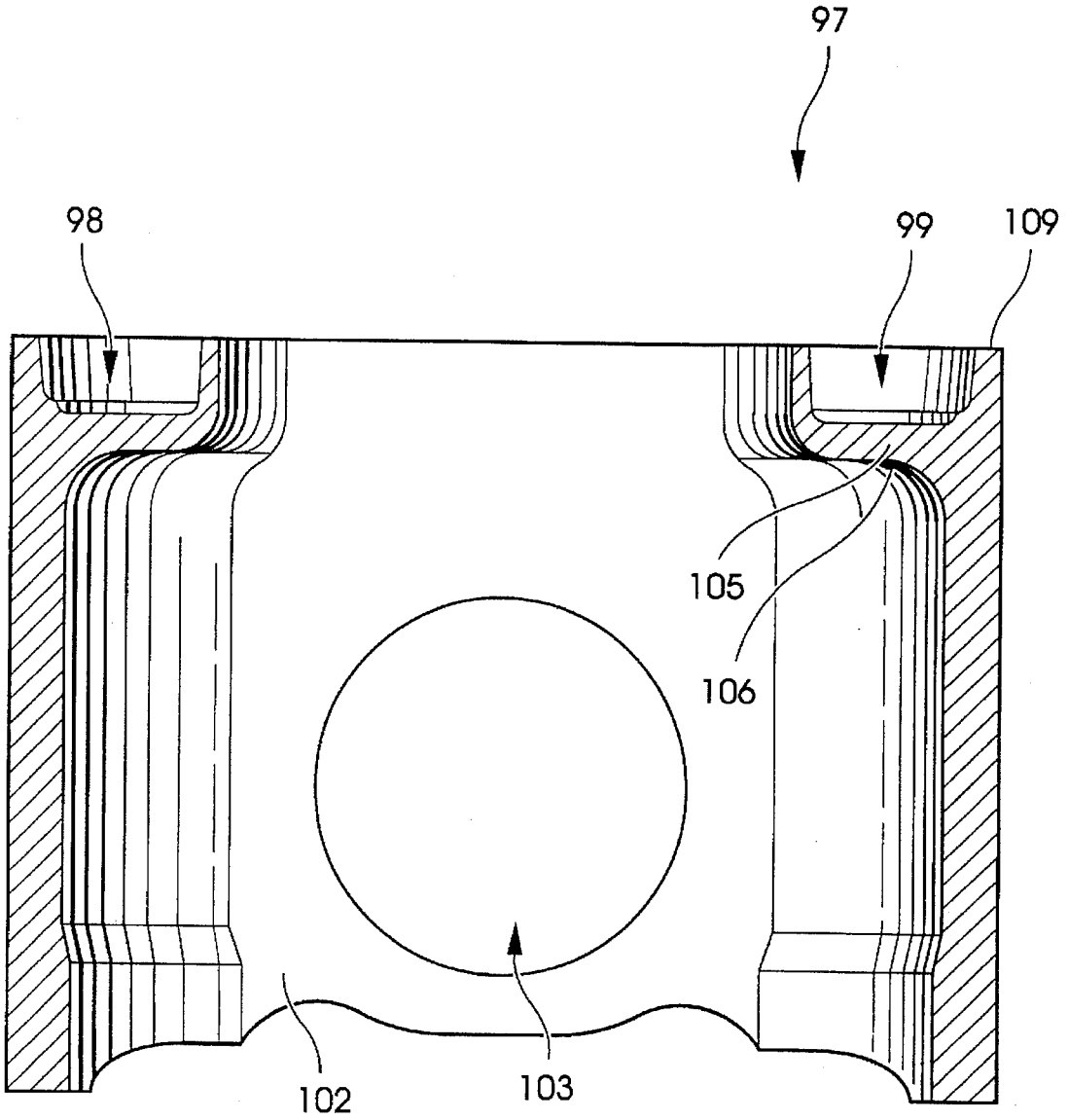
FIG. 12 is a side elevational view in full section of the FIG. 11 skirt portion.
Figure 13:
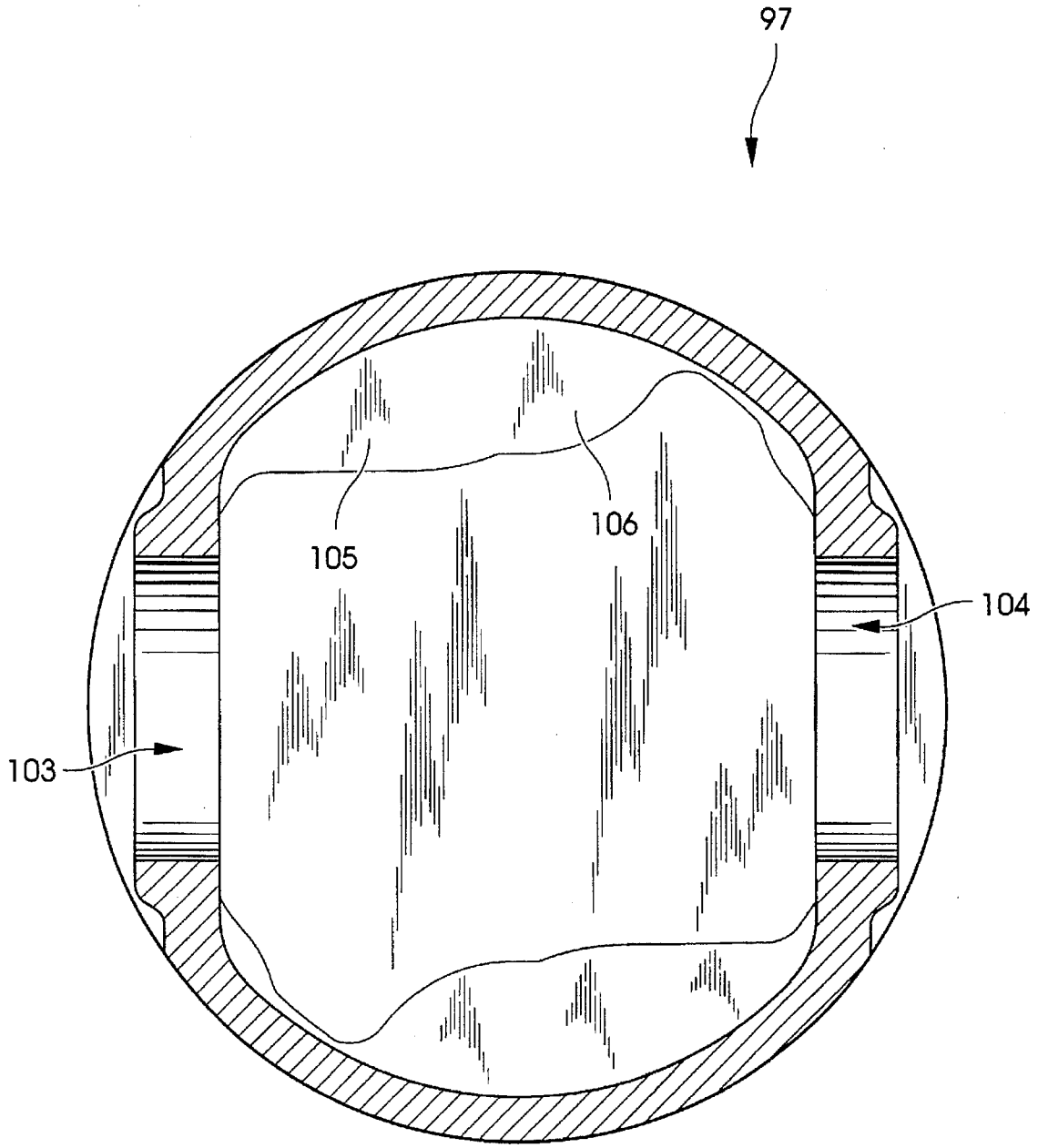
FIG. 13 is a bottom plan view in full section of the FIG. 11 skirt portion as viewed in the direction of line 13—13 in FIG. 11.
Figure 14:
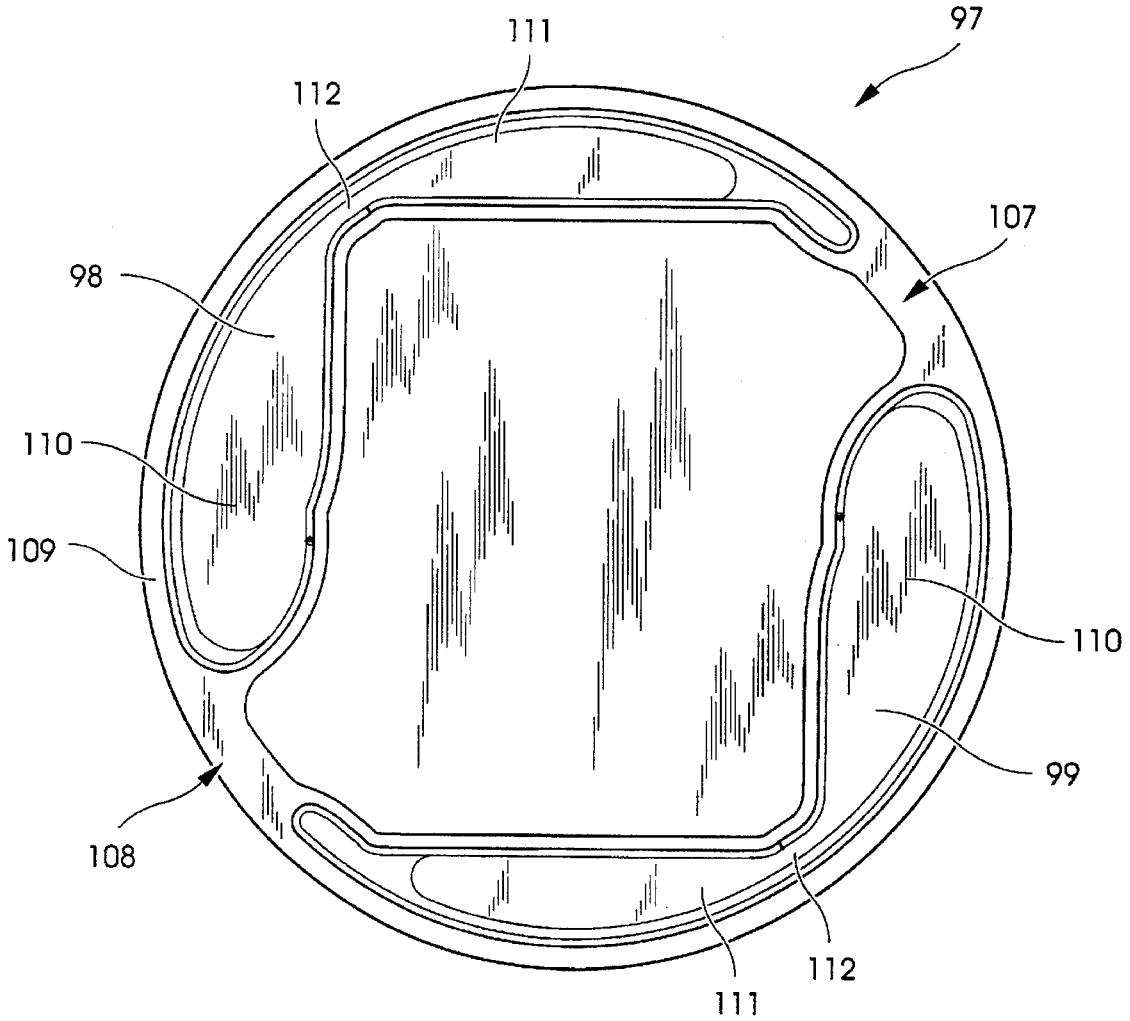
FIG. 14 is a top plan view of the FIG. 11 skirt portion showing the oil collection chambers.

Referring to FIGS. 8–10, the crown portion 82 of the corresponding articulated piston is illustrated. Crown portion 82 includes an outer wall 83 with a plurality of compression ring grooves 84 and 85 and an oil ring groove 86. As illustrated, the combustion chamber 87 has a curved geometry which is symmetrical on either side of axial centerline 88. Piston pin support arms 89 and 90 are each sleeved with a bronze bearing 91 and 92, respectively. Annular cooling channel or gallery 96 provides a means to collect and distribute cooling oil for the crown portion. As will be described in greater detail hereinafter, open target areas are left in gallery 96 once the skirt portion 97 (see FIGS. 11–14) is assembled. The skirt portion 97 is configured with two circumferentially separated oil collection pockets 98 and 99 (see FIG. 14) whose open face side is positioned up and against and over gallery 96. The two circumferentially separated oil collection pockets are each 180 degrees apart and either open target area is suitable so as to create a point of entry for the targeted jets of oil spray from nozzle holes 45–58. The point of entry is in flow communication with gallery 96 and correspondingly with the two oil collection pockets. Whichever open target area is not used as the clearance entrance into gallery 96 (i.e., the one which is not the oil spray target) provides an exit path for the collected oil.

Referring now to FIGS. 11–14, skirt portion 97 is illustrated in detail. Skirt portion 97 includes a generally cylindrical outer wall 102 defining two oppositely disposed piston pin bores 103 and 104. The hollow inside surface is substantially smooth throughout, terminating at its upper end in top plate portion 105. The inside surface 106 of the top plate portion 105 is closed beneath the two oil collection pockets 98 and 99. Radial recesses 107 and 108 provide the clearance (i.e., open target areas) for access to gallery 96.

When a targeted spray of cooling oil is directed at either recess 107 or recess 108, the flow of oil passes without blockage into the adjacent portion of annular gallery 96 in the crown portion 82. The oil then flows and collects in pockets 98 and 99 which are defined by the outer, upper surface 109 of top plate portion 105. Each collection pocket 98 and 99 has a curved, L-like shape with two larger areas 110 and 111 connected by a smaller neck area 112. Whatever flow of oil enters one of the two larger areas is able to flow to the other, connected area. It does not matter whether recess 107 or 108 is used as the target area to the piston gallery. The design of the skirt portion is symmetrical (though reversed) on either side of any diametral dividing line.

The collected oil provides cooling to the crown portion as the oil continues to flow by way of the piston cooling nozzle. The hotter oil that exits the piston gallery flows out through the other recess and makes room for cooler oil to be introduced and this process continues so long as there is pressurized oil flow through the oil rifle 79.

Figure 15:
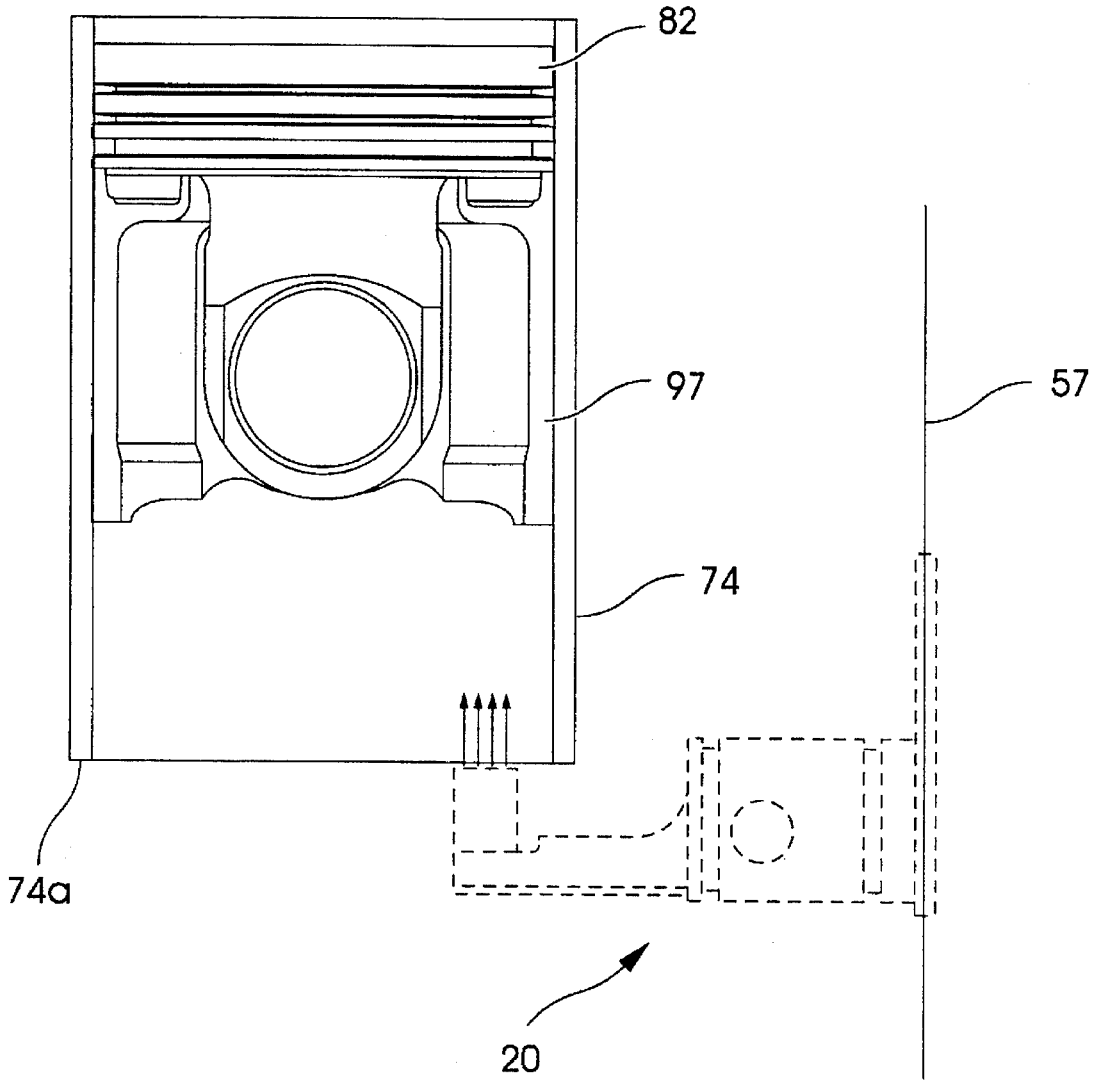
FIG. 15 is a diagrammatic side elevational view of the FIG. 1 piston cooling nozzle as installed into the FIG. 6 engine block and with the FIG. 8 crown portion and FIG. 11 skirt portion assembled together and positioned in the engine block.

Referring to FIG. 15, there is illustrated in diagrammatic form a side elevational view of a piston cooling nozzle 20 according to the present invention as installed in an engine block. In the FIG. 15 illustration, the articulated piston including crown portion 82 and skirt portion 97 have been assembled and placed within the corresponding cylinder liner. From the FIG. 15 illustration it can be seen how the piston cooling nozzle 20 is positioned relative to the engine block and relative to the cylinder liner. It is also possible to visualize how the piston cooling nozzle has its four nozzle holes 45–48 pointed in an upward direction at the open area into the piston gallery as defined by the combination of the crown portion and skirt portion. As illustrated, nozzle extension 24 extends in an axial direction toward cylinder liner 74. This direction is substantially parallel with the axis of the cylinder liner. Nozzle extension 24 is positioned very close to lower edge **74*a***, but with a slight clearance. This enables the piston cooling nozzle to be installed and removed without interference and without any other disassembly being required.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. A piston cooling nozzle for an internal combustion engine, wherein the engine includes an engine block, cylinder liner, and piston, the engine block defining an oil rifle and the piston including a cooling gallery, said piston cooling nozzle comprising:

a main body defining an open interior region which is arranged for receipt of a cooling fluid;

an extension arm in unitary construction with said main body, said extension arm defining at least one flow passageway which is in flow communication with said interior region;

a nozzle extension in unitary construction with said extension arm and defining a plurality of flow jet passages which are in flow communication with said at least one flow passageway;

a base including an end plate which is constructed and arranged to mount to an outer surface of the engine block and a plug portion which is inserted into said main body; and said plurality of flow jet passages having an arc-like pattern in lateral section and exiting from said nozzle extension.

2. The piston cooling nozzle of claim 1 wherein said extension arm longitudinally extends in a first direction and said nozzle extension axially extends in a second direction, said second direction being substantially perpendicular to said first direction.

3. The piston cooling nozzle of claim 1 wherein said nozzle extension has a substantially triangular periphery.

4. A piston cooling nozzle for an internal combustion engine, wherein the engine includes an engine block, cylinder liner, and piston, the engine block defining an oil rifle and the piston including a cooling gallery, said piston cooling nozzle comprising:

a mounting base constructed and arranged for attachment to an outer surface of said engine block;

a main body portion defining a hollow interior space and being open at one end and receiving therein an inserting portion of said mounting base;

an extension arm portion in unitary construction with said main body portion and defining therethrough at least one flow passageway, said at least one flow passageway being in flow communication with said interior space;

a cooling nozzle head defining a plurality of flow jet passages each of which is constructed and arranged in flow communication with said interior space by way of said extension arm portion; and wherein said plurality of flow jet passages are directed at said cooling gallery and wherein said interior space is in flow communication with said oil rifle such that cooling oil flowing through said oil rifle is directed at said cooling gallery by said plurality of flow jet passages.

5. The piston cooling nozzle of claim 4 wherein said piston is constructed and arranged with a cooling gallery opening and said plurality of flow jet passages are arranged in a pattern which is in alignment with and simulates the shape of said cooling gallery opening.

6. The piston cooling nozzle of claim 4 wherein said cooling nozzle head has a substantially triangular periphery.

7. The piston cooling nozzle of claim 5 wherein said extension arm portion longitudinally extends in a first direction and said cooling nozzle head axially extends in a second direction, said second direction being substantially perpendicular to said first direction.

8. The piston cooling nozzle of claim 4 wherein said extension arm portion longitudinally extends in a first direction and said cooling nozzle head axially extends in a second direction, said second direction being substantially perpendicular to said first direction.

9. In combination:

an engine block having an outer surface and defining an oil rifle;

a cylinder liner and piston assembly, the piston of said assembly arranged with a piston cooling gallery, said piston cooling gallery defining an opening; and a piston cooling nozzle comprising:

a mounting base constructed and arranged for attachment to the outer surface of said engine block;

a main body portion defining a hollow interior space and being open at one end and receiving therein an inserting portion of said mounting base;

an extension arm portion in unitary construction with said main body portion and defining therethrough at least one flow passageway, said at least one flow passageway being in flow communication with said interior space;

a cooling nozzle head defining a plurality of flow jet passages each of which is constructed and arranged in flow communication with said interior space by way of said extension arm portion; and wherein said plurality of flow jet passages are directed at said cooling gallery and wherein said interior space is in flow communication with said oil rifle such that cooling oil flowing through said oil rifle is directed at said cooling gallery by said plurality of flow jet passages.

10. The combination of claim 9 wherein said extension arm portion longitudinally extends in a first direction and said cooling nozzle head axially extends in a second direction, said second direction being substantially perpendicular to said first direction.

11. The combination of claim 10 wherein said cylinder liner includes a lower edge and said cooling nozzle head extending in said second direction upwardly toward said lower edge and being spaced apart from said lower edge.

12. The combination of claim 11 wherein said piston cooling nozzle being arranged relative to said engine block and said cylinder liner such that the piston cooling nozzle can be installed and removed without interference with said cylinder liner.

* * * * *